United States Patent [19]

Sugiyama

[11] 4,447,684

[45] May 8, 1984

[54] AUTOMOTIVE HORN SWITCH STRUCTURE ON STEERING WHEEL

[75] Inventor: Tomokazau Sugiyama, Fuji, Japan

[73] Assignee: Nihon Plast Co., Ltd., Shizuoka, Japan

[21] Appl. No.: 514,232

[22] Filed: Jul. 15, 1983

[30] Foreign Application Priority Data

Jul. 16, 1982 [JP] Japan ..... 57-108278[U]

[51] Int. Cl.[3] ..... H01H 9/00

[52] U.S. Cl. ..... 200/61.54; 200/61.57

[58] Field of Search ..... 200/61.54–61.57

[56] References Cited

U.S. PATENT DOCUMENTS 2,361,630 10/1944 Jacobi ..... 200/61.57

FOREIGN PATENT DOCUMENTS 58-14142 3/1983 Japan .

172704 12/1921 United Kingdom ..... 200/61.57

*Primary Examiner*—J. R. Scott

*Attorney, Agent, or Firm*—Armstrong, Nikaido, Marmelstein & Kubovcik

[57] ABSTRACT

An automotive horn switch structure has a contact plate secured to a steering wheel and electrically connected to a minus terminal of an electric power source, a horn spring connected by an electric wire to an electrically energizable horn and having integral contact points movable into contact with the contact plate by a horn button mounted on the steering wheel, and a fastener of a plastic material fastening the contact plate, the horn spring and the wire together. The fastener has a pair of self-locking legs securing the contact plate to the fastener and a pair of spaced self-locking legs which grasp and hold the horn spring and an exposed end of the wire together to form an electrical connection therebetween.

6 Claims, 8 Drawing Figures

AUTOMOTIVE HORN SWITCH STRUCTURE ON STEERING WHEEL

FIELD OF THE INVENTION

The present invention relates to an automotive horn switch structure mounted on a steering wheel.

SUMMARY OF THE INVENTION

The present invention has a primary object to provide an improved automotive horn switch structure having component parts which can be easily assembled and secured together without the use of any screw.

The automotive horn switch structure according to the present invention includes a contact plate secured to a steering wheel, a horn spring and a fastener of an electrically insulating material securing the contact plate and the horn spring together such that the contact plate and the horn spring are electrically insulated from each other. The horn spring has at least one integral contact point adapted to be actuated by a horn button on the steering wheel into contact with the contact plate. The contact plate is electrically connected to one of plus and minus terminals of an electric power source and the horn plate is electrically connected through an electric wire to an electrically energizable horn electrically connected to the other terminal of the power source. When the contact point is actuated by the horn button, the horn is electrically energized. The fastener includes a base having first and second surfaces and self-locking resilient legs formed integrally with the base, extending from the first surface and cooperating with the base to secure the contact plate to the fastener. The improvement according to the present invention comprises a pair of spaced self-locking resilient pawls integrally formed with the base, extending from the second surface thereof and having locking claws extending toward each other. The self-locking pawls cooperate with the base to grasp and hold a part of the horn plate between the second surface and the locking claws. The electric wire has a part grasped and held between said part of the horn plate and the second surface of the base so that the wire is electrically connected to the horn plate.

DESCRIPTION OF THE PRIOR ART

Figure 1:
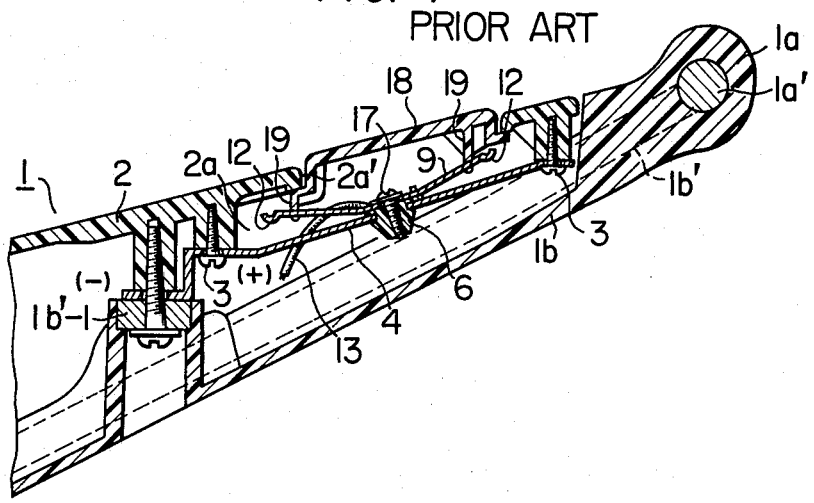
FIG. 1 PRIOR ART
FIG. 1 is a longitudinal sectional view of the prior art automotive horn switch structure mounted on a steering wheel.
Figure 2:
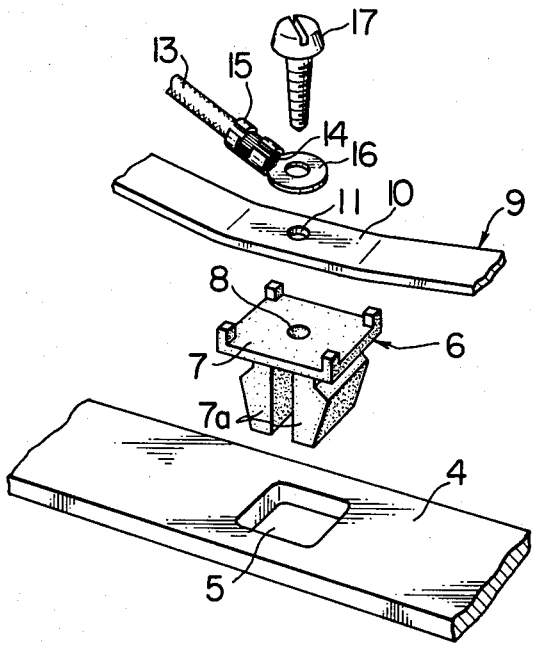
FIG. 2 PRIOR ART
FIG. 2 shows in perspective view the component parts of the prior art horn switch structure when they are in disassembled positions.
Figure 3:
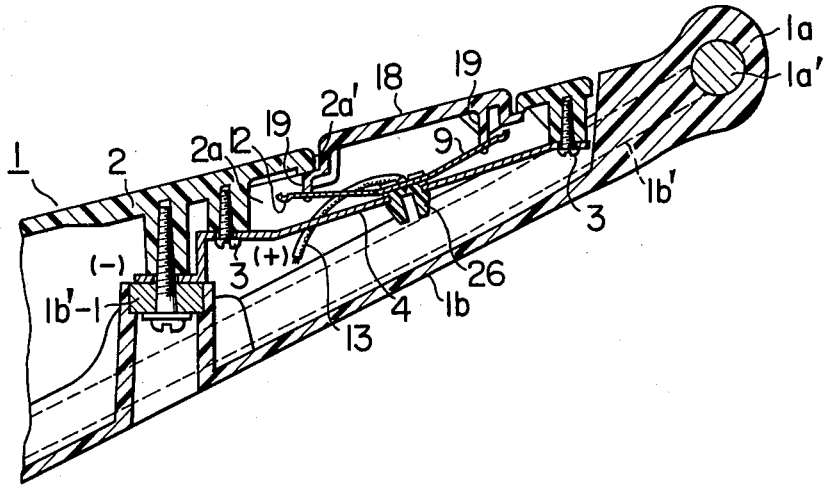
FIG. 3 is a view similar to FIG. 1 but shows an embodiment of the automotive horn switch structure according to the present invention.
Figure 4:
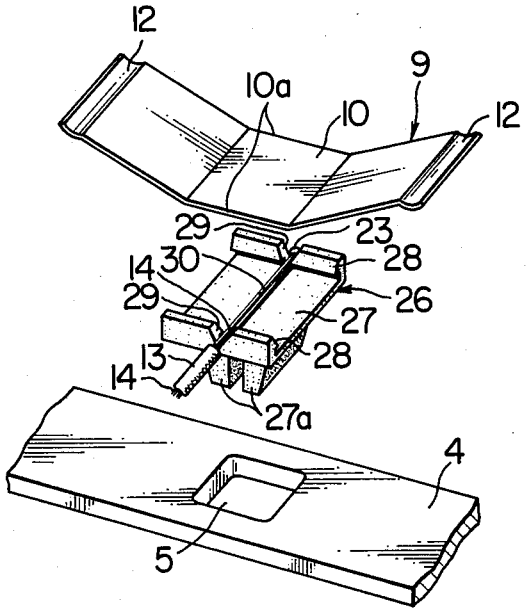
FIG. 4 shows in perspective view the component parts of the horn switch structure of FIG. 2 when they are in disassembled positions.

Referring to FIGS. 1 and 2 showing the prior art, an automotive steering wheel 1 includes rim and integral spoke 1*a* and 1*b* which are formed by a moulded plastic material. Rim core 1*a*′ and spoke core 1*b*′ are embedded in and extend through the rim 1*a* and spoke 1*b*, respectively. A bracket 1*b*′-1 of a metal is mechanically and electrically connected to the spoke core 1*b*′ and mounted on the top of a projection formed integrally with the spoke 1*b*. A spoke cover 2 of a molded plastic material is detachably mounted on the spoke 1*b* to cooperate therewith to define a recess 2*a* having an opening 2*a*′ formed in the spoke cover 2 and closed by a horn button 18 of a molded plastic material. The bracket 1*b*′-1 is electrically connected to the minus terminal of an electric power source (not shown) to form a minus terminal, as indicated by "(−)" in FIG. 1.

The recess 2*a* accommodates a horn switch structure which includes an elongated contact plate 4 of a metal such as phosphor bronze secured to the inner surface of the spoke cover 2 by means of screws 3 and disposed beneath the horn button 18 and electrically connected to the bracket 1*b*′-1. A fastener 6 of a plastic material has a generally flat upper section or base 7 and a pair of self-locking resilient legs 7*a* snapped into a hole 5 in the contact plate 4 to mechanically connect the contact plate 4 and the fastener 6 together. An elongated and generally arcuate horn spring 9 of a metal such as phosphor bronze has a central flat section 10 formed therein with a central hole 11 and also has downwardly projecting semi-circular contact points 12 formed at the opposite ends of the horn spring 9. A horn cord 13 includes an electric wire 14 covered with an insulating covering and having an exposed end connected to a generally sleeve-like clamping section 15 of an eye-connector 16 which is placed on the central section 10 of the horn spring 9 in alignment with the hole 11 and firmly secured to the flat base 7 of the fastener 6 together with the horn spring 9 by means of a self-tapping screw 17 extending through the eye-connector 16 and through the hole 11 into a hole 8 formed in the flat base 7 of the fastener 6, thus completing an electrical connection between one end of the horn cord 13 and the horn spring 9. The other end of the horn cord 13 is electrically connected to a conventional electrically energizable horn which is not shown but represented by "(+)" in FIG. 1. The horn button 18 has a pair of inwardly extending legs or ribs 19 engaged with the horn spring 9 at points slightly inwardly offset from the contact points 12 so that the horn spring normally upwardly resiliently biases the horn button 18 into contact with the undersurface of the inner peripheral edge of the opening 2*a*′ formed in the spoke cover 2. The horn button 18 is inwardly or downwardly movable by an operator to downwardly resiliently deform the horn spring 9 for thereby moving at least one of the contact points 12 of the horn spring into electrical contact with the contact plate 4, so that the switch is closed to electrically connect the minus terminal 1*b*′-1 to the horn (not shown) to electrically energize the same.

With the described structure of the prior art horn switch, however, to connect the horn cord 13 to the horn spring 9 requires troublesome and time-consuming steps of first removing an end portion of the covering of the cord 13 to expose the end of the wire 14, either inserting the exposed end of the wire 14 into the clamping section 15 of the eye-connector 16 and deforming the clamping section 15 or securing the exposed end of the wire 14 to an eye-connector 16 by brazing, for example, and inserting the self-tapping screw 17 into the eye-connector 16 to secure the same and the horn spring 9 to the flat base 7 of the fastener 6. In addition, the prior art structure inevitably needs the relatively expensive self-tapping screw 17.

DESCRIPTION OF PREFERRED EMBODIMENTS OF INVENTION

Referring first to FIGS. 3 to 6 in which the parts the same as those shown in FIGS. 1 and 2 are designated by the same reference numerals to avoid unnecessary repetition of description of the conventional or known parts, a fastener 26 formed of a molded electrically insulating plastic material, such as polyacetal or PBT resin, includes a substantially flat and quadrilateral base 27, a pair of self-locking resilient legs **27*a* extending from the bottom surface of the base 27 and snapped into the hole 5 in the contact plate 4 to secure the plate 4 to the fastener 27, as in the prior art described with reference to FIGS. 1 and 2, and a pair of self-locking resilient pawls in the form of substantially parallel side walls 28 extending from the top surface of the base 27 and formed along the two opposite edges thereof and substantially coextensive with these edges. The self-locking legs 27*a* and side walls 28 are integral with the base 27. The side walls have locking claws 28*a* extending toward each other, as will be best seen in FIG. 5. The locking claws 28*a* are each of a triangular cross-section and cooperate with the top surface of the base 27 to define a space for receiving therein the flat central section 10 of the horn spring 9. The spacing between the inner edges of the locking claws 28*a* is slightly smaller than the width or the dimension of the central section 10 of the horn spring 9 as measured between the side edges 10*a* of the section 10. The side walls 28 of the fastener 26 has a resiliency so that, when the central section 10 of the horn spring 9 is placed between the downwardly inclined surfaces of the locking claws 28*a* and pressed downwardly, the side walls 28 can be resiliently outwardly deformed until the side edges 10*a* of the central section 10 of the horn spring 9 downwardly clear the inner edges of the claws 28*a*. Thereafter, the resiliency returns the side walls 28 to their initial or normal upstanding positions to cause the locking claws 28*a* to cooperate with the flat top surface of the base 27 to grasp and hold the central section 10 of the horn spring 9**.

A groove 30 is formed in the flat top surface of the base 27 and extends between the opposite side walls 28. Generally V-shaped notches 29 are formed in the side walls 28 and aligned with the groove 30 so that the bottom portions of the notches 29 are communicated with the groove 30.

An end portion of the covering of an electric cord 13 is removed to expose an end portion of the wire 14. A ball 23 of a metal such as solder or lead is fixed to the end extremity of the exposed end portion of the wire 14. Alternatively, a knot may be formed on the exposed end portion of the wire 14 at the end extremity thereof. The ball 23 or the knot may preferably has a diameter greater than the diameter of the electric cord 13.

Figure 5:
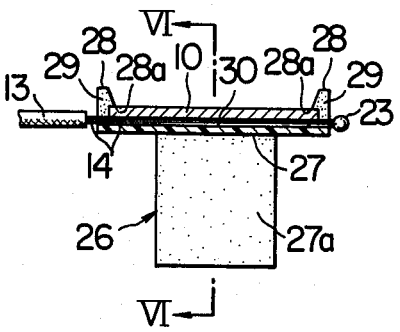
FIG. 5 is a sectional view of a fastener shown in FIGS. 3 and 4 taken along line V—V in FIG. 6.
Figure 6:
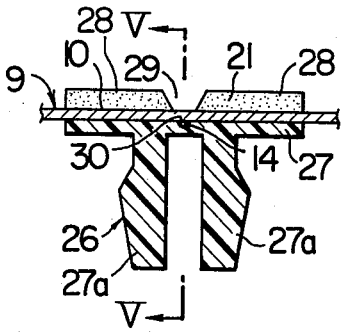
FIG. 6 is another sectional view of the fastener taken along line VI—VI in FIG. 5.

Before the central section 10 of the horn spring 9 is snapped into locking engagement with the self-locking pawls or side walls 28 of the fastener 26, the exposed end portion of the wire 14 is placed in the notches 29 and the groove 30 formed in the fastener 26 so that the metal ball 23 or the knot mentioned above is positioned outside one of the notches 29 and the covering of the wire 14 is positioned adjacent to the other notch 29, as best shown in FIG. 5. Thereafter, the central section 10 of the horn spring 9 is snapped into locking engagement with the self-locking pawls or side walls 28. In this position, the locking claws **28*a* engage with the edges 10*a* of the central section 10 of the horn spring 9 to grasp and hold the same in face-to-face contact with the top surface of the base 27 of the fastener 26 so that the electric wire 14 now in the groove 30 is sandwiched between the base 27 of the fastener 26 and the central section 10 of the horn spring 9 to form an electrical connection between the horn spring 9 and the electric wire 14. The metal ball 23 or the knot formed on the wire 14 forms means for preventing the wire 14 from being pulled off or dislodged from the horn spring 9 and the fastener 26. The preventing means may be in any convenient form other than the metal ball 23** and the knot mentioned above.

As described, the horn spring 9 and the wire 14 of the electric cord 13 can easily be mechanically firmly connected to the fastener 26 to automatically form the electrical connection between the horn spring 9 and the wire 14. The mechanical connection does not need any screw. The electrical connection does not require any conventional wire connector. The assembling and connecting steps are greatly simplified. Thus, the described horn switch structure is suited for mass production and can be formed by reduced number of component parts and manufactured at a reduced cost.

Figure 7:
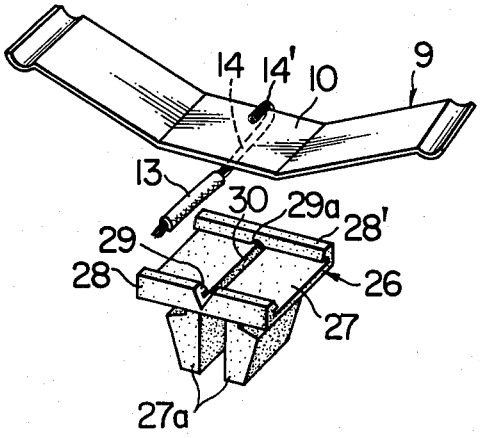
FIG. 7 is similar to FIG. 4 but illustrates a modified embodiment of the invention.
Figure 8:
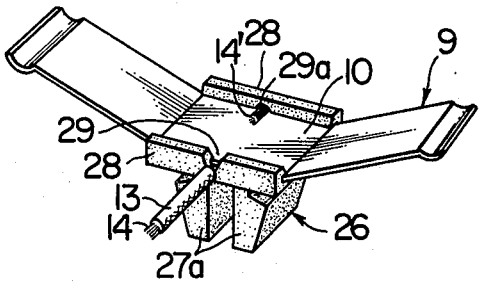
FIG. 8 shows in perspective view the modified component parts shown in FIG. 7 when they are in assembled positions.

FIGS. 7 and 8 illustrate a modification to the described embodiment of the invention. The modified embodiment includes a modified fastener 26 in which one of the side walls 28' is formed with a notch 29, as in the embodiment described above, but the other side wall 28 is formed therein with a lateral through-hole **29*a* disposed in alignment with a groove 30. An exposed end portion of wire 14 of the cord 13 is first so positioned as to extend across the undersurface of the central section 10 of the horn spring 9. Then, the end extremity 14' of the exposed end portion of the wire 14 is bent upwardly about an adjacent edge of the horn spring 9. The central section 10 of the horn spring 9 with the bent wire 14 attached thereto is secured to the fastener 26 in such a manner that the edge of the horn spring 9 about which the wire 14 is bent is first inserted into the elongated recess or groove formed between the locking claw of the side wall 28' and the flat top surface of the base 27 of the fastener 26 and the bend of the wire 14 is received in the through-hole 29*a* and, thereafter, the other edge of the horn spring 9 is snapped into the elongated recess or groove formed between the locking claw of the other side wall 28 and the flat top surface of the base 27 of the fastener 26**.

The bent portion 14' of the exposed wire 14 is operative to prevent the wire 14 from being pulled away and dislodged from the horn spring 9 and the fastener 26. Thus, the modified embodiment does not require the metal ball 23 or the knot employed in the first embodiment of the invention.

What is claimed is:

1. An automotive horn switch structure mounted on a steering wheel having a horn button, comprising a contact plate secured to said steering wheel, a horn spring and a fastener of an electrically insulating material securing said contact plate and said horn spring together such that said contact plate and said horn spring are electrically insulated from each other, said horn spring having at least one integral contact point adapted to be actuated by said horn button into contact with said contact plate, said contact plate being electrically connected to one of plus and minus terminals of an electric power source and said horn sprng being electrically connected through an electric wire to an electrically energizable horn electrically connected to the other terminal of said power source whereby, when said contact point of said horn spring is actuated by said horn button into contact with said contact plate, said horn is electrically energized, said fastener including a base having first and second surfaces and self-locking resilient legs formed integrally with said base extending from said first surface and cooperating with said base to secure said contact plate to said fastener, wherein said fastener further includes a pair of spaced self-locking resilient pawls integrally formed with said base, extending from said second surface thereof and having locking claws extending toward each other, said self-locking pawls cooperating with said base to grasp and hold a part of said horn plate between said second surface of said base and said locking claws, said electric wire having a part grasped and held between said part of said horn plate and said second surface of said base so that said wire is electrically connected to said horn plate.

2. An automotive horn switch structure according to claim 1, wherein said first and second surfaces are directed substantially in the opposite directions and wherein said base is substantially flat and has two substantially parallel sides and said self-locking pawls are in the form of side walls formed along said two sides of said base and substantially coextensive therewith, respectively.

3. An automotive horn switch structure according to claim 2, wherein said second surface of said base is formed therein with a groove extending between said side walls, said side walls are respectively formed therein with notches substantially aligned with said groove, and said wire part extends through said notches and along said groove.

4. An automotive horn switch structure according to claim 3, wherein said wire part has an end extremity extending slightly outwardly from one of said notches and carries thereon means for preventing said wire part from being dislocated from said horn plate part and said fastener.

5. An automotive horn switch structure according to claim 4, wherein said preventing means comprises a ball of a metal formed on said wire part end extremity.

6. An automotive horn switch structure according to claim 2, wherein said second surface of said base is formed therein with a groove extending between said side walls, one of said side walls is formed therein with a notch substantially aligned with said groove, the other side wall is formed therein with a hole substantially aligned with said groove, said wire part extends through said notch and along said groove and has an end portion bent about an adjacent edge of said horn plate part and the bend of said wire part is at least partly received in said hole.

* * * * *